US007748500B2

(12) United States Patent
Nagano et al.

(10) Patent No.: US 7,748,500 B2
(45) Date of Patent: Jul. 6, 2010

(54) OIL PAN FOR INTERNAL COMBUSTION ENGINE

(75) Inventors: Naomichi Nagano, Wako (JP); Hirosuke Niwa, Wako (JP); Takashi Yokoi, Wako (JP); Junya Iino, Wako (JP); Makoto Ito, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/108,834

(22) Filed: Apr. 24, 2008

(65) Prior Publication Data

US 2008/0264727 A1 Oct. 30, 2008

(30) Foreign Application Priority Data

Apr. 26, 2007 (JP) ..... 2007-116974

(51) Int. Cl.
*F02B 77/00* (2006.01)

(52) U.S. Cl. ..... 184/106

(58) Field of Classification Search ..... 184/106
See application file for complete search history.

(56) References Cited

U.S. PATENT DOCUMENTS

| | | | | |
|---|---|---|---|---|
| 5,038,890 | A * | 8/1991 | Tanaka et al. | 184/6.5 |
| 5,664,537 | A | 9/1997 | Beranek et al. | |
| 5,960,908 | A * | 10/1999 | Kasahara | 184/106 |
| 6,845,743 | B1 * | 1/2005 | Bishop | 123/195 C |
| 7,240,657 | B2 * | 7/2007 | Watanabe | 123/196 R |

FOREIGN PATENT DOCUMENTS

| | | |
|---|---|---|
| GB | 2 276 205 | 9/1994 |
| JP | 57-66211 | 4/1982 |
| JP | 58-14445 | 1/1983 |
| JP | 61-004811 | 1/1986 |
| JP | 62-16711 | 1/1987 |
| JP | 62-142818 | 6/1987 |
| JP | 05-010210 | 1/1993 |
| JP | 5-50012 | 7/1993 |
| JP | 5-179921 | 7/1993 |
| JP | 6-58111 | 8/1994 |
| JP | 06-336952 | 12/1994 |
| JP | 10-196340 | 7/1998 |
| JP | 2002-276324 | 9/2002 |
| JP | 2007-009738 | 1/2007 |

* cited by examiner

*Primary Examiner*—John Q Nguyen
*Assistant Examiner*—Robert T Reese
(74) *Attorney, Agent, or Firm*—Rankin, Hill & Clark LLP

(57) ABSTRACT

An oil pan is disposed in a lower part of an internal combustion engine and has an oil pan body divided, with respect to a vertical direction, into oil pan elements having bottom walls respectively of different depths. A baffle plate divides the interior of the oil pan body into a plurality of spaces at the boundary of adjacent ones of the bottom walls to regulate the flow of oil between the adjacent ones of spaces. The baffle plate is divided with respect to a vertical direction into a plurality of baffle plate elements. The baffle plate elements are formed integrally with the oil pan elements, respectively. The oil pan for an internal combustion engine can be manufactured by reduced time and reduced labor at a low manufacturing cost.

8 Claims, 8 Drawing Sheets

OIL PAN FOR INTERNAL COMBUSTION ENGINE

BACKGROUND OF THE INVENTION

1. Field of the Invention

The present invention relates to an oil pan which acts as an oil reservoir disposed in a lower part of an internal combustion engine.

2. Description of the Related Art

Various oil pans like such an oil pan are proposed in, for example, JP-U 57-66211 A. The interior of the previously proposed oil pan is divided into a deep bottom space, namely, a lowermost space, and a shallow bottom space, by a baffle plate disposed near the boundary between a deep-bottom section and a shallow-bottom section. The baffle plate regulates the flow of the oil between the deep bottom space and the shallow bottom space. Particularly, the flow of the oil from the deep bottom space into the shallow bottom space is regulated such that an amount of the oil not smaller than a predetermined amount is always reserved in the deep bottom space so that the oil can be surely pumped up from the bottom of the deep bottom space.

The previously proposed oil pan is provided with a separate baffle plate attached to a part of an oil pan body near the boundary between the deep-bottom section and the shallow-bottom section.

Openings are provided in a base part of the baffle plate joined to the oil pan body. The oil pan body and the baffle plate need to be manufactured individually, the oil pan is built by joining the baffle plate to the oil pan body, and the openings need to be formed in the baffle plate. Thus the oil pan has many component members, and requires many man-hours and much cost to manufacture the same.

The shape of oil pans has become complicated in recent years. Consequently, the number of the component parts of oil pans, and man-hours needed to manufacture oil pans, have progressively increased.

SUMMARY OF THE INVENTION

The present invention has been made in view of the foregoing problems and it is therefore an object of the present invention to provide an oil pan for an internal combustion engine capable of being manufactured by reduced time and labor at a reduced cost.

To attain the above object, the present invention provides an oil pan for an internal combustion engine, disposed in a lower part of the internal combustion engine. Said oil pan comprises; an oil pan body having a plurality of bottom sections respectively having different depths, and a baffle plate disposed between adjacent ones of the bottom sections to regulate flow of oil between adjacent ones of spaces defined by the bottom sections; wherein the oil pan body having the bottom sections of different depths is divided into oil pan elements with respect to a vertical direction; the baffle plate is divided together with the oil pan body into half baffle plates; and the half baffle plates are formed integrally with the oil pan elements, respectively.

In the oil pan of the present invention for an internal combustion engine, the baffle plate is divided into the half baffle plates together with the oil pan elements, and the half baffle plates are formed integrally with the oil pan elements, respectively. Therefore, the baffle plate elements can be formed integrally with the oil pan elements, respectively, and the oil pan can be produced by simply joining the oil pan elements. Thus the oil pan of the present invention needs a reduced number of component members and reduced man-hours. Thus the oil pan requires reduced time and labor for manufacturing the same.

Preferably, the oil pan body has a shallow-bottom section having a smaller depth, and a deep-bottom section having a greater depth, the oil pan body is divided into an upper oil pan element having the shallow-bottom section, and a lower oil pan element having the deep-bottom section; the baffle plate is divided into an upper half baffle plate and a lower half baffle plate respectively for the upper oil pan element and the lower half oil pan element; the upper half baffle plate is formed integrally with the upper oil pan element; and the lower half baffle plate is formed integrally with the lower oil pan element.

The upper and the lower half baffle plate can be formed integrally with the upper and the lower half oil pan, respectively, and the oil pan provided with the baffle plate can be completed simply by joining together the upper and the lower half oil pan. Thus the oil pan has a reduced number of component members, requires reduced man-hours, and can be manufactured by reduced time and labor.

Preferably, the baffle plate divides the interior space of the oil pan into a deep space and a shallow space, the baffle plate is provided with an opening by means of which the deep and the shallow space communicate with each other, and the opening is formed by cutting the lower half baffle plate downward from an upper edge of the lower half baffle plate. The opening can be easily formed in the lower half baffle plate.

Desirably, the opening is formed in each of opposite side parts of the lower half baffle plate. The oil flows along the opposite side walls of the lower half oil pan and hence the oil in a central part of the deep space can be stabilized.

An oil strainer may be extended through a concavity formed in the baffle plate to be held on the baffle plate so as to extend in both the shallow and the deep space.

Typically, the oil strainer has a suction opening disposed adjacent to a central part of the deep space, trough-shaped oil passages are formed along inside surfaces of the opposite side walls of the upper oil pan element near the opposite side parts of the upper half baffle plate of the upper oil pan element, and return openings are formed in the bottoms of the oil passages to cause the oil to drop into the lower oil pan element.

The collected oil flows in the opposite oil passages, and can drop into regions spaced a long distance apart from the central region in the lower oil pan element through the return openings formed in the opposite oil passages. Thus the oil in the central region in which the suction opening of the oil strainer is located can be stabilized to prevent the oil strainer from sucking air.

The return openings may be formed in the bottoms of the oil passages so as to open into the shallow space. When the return openings are thus formed, the oil drops through the return openings into a space separated by the baffle plate from the deep space, in which the suction opening of the oil strainer is located. Thus the baffle plate prevents the disturbance of the oil in the deep space by the oil that would otherwise drop into the deep space to stabilize the oil in the deep space. Consequently, suction of air by the oil strainer can be reduced to the least possible extent.

Desirably, the concavity through which the oil strainer is extended is formed in the upper baffle plate so as to open upward. Thus the concavity, namely, the recess opening upward, for the oil strainer can be easily formed. The oil strainer extended through the concavity does not protrude upward from the oil pan. Therefore, the oil strainer does not place any restrictions on the arrangement of parts above the oil pan and the internal combustion engine can formed in a low height.

Preferably, the oil strainer is provided with a flange-like member greater in area than the concavity for the oil strainer. The flange-like member is disposed contiguously with the concavity when the oil strainer is extended through the concavity. Thus the flow of the oil between the deep and the shallow space through the concavity can be suppressed.

The oil pan is mounted on a vehicle, and a middle part of the baffle plate may be bulged in a running direction in which the vehicle runs for forward travel. When the baffle plate is thus formed, a large amount of the oil that moves forward when the vehicle decelerates is held in the bulged middle part of the baffle plate and hence the amount of the oil that flows forward beyond the baffle plate can be reduced.

DESCRIPTION OF THE PREFERRED EMBODIMENTS

An oil pan 10 in a preferred embodiment of the present invention will be described with reference to FIGS. 1 to 8.

Figure 1:
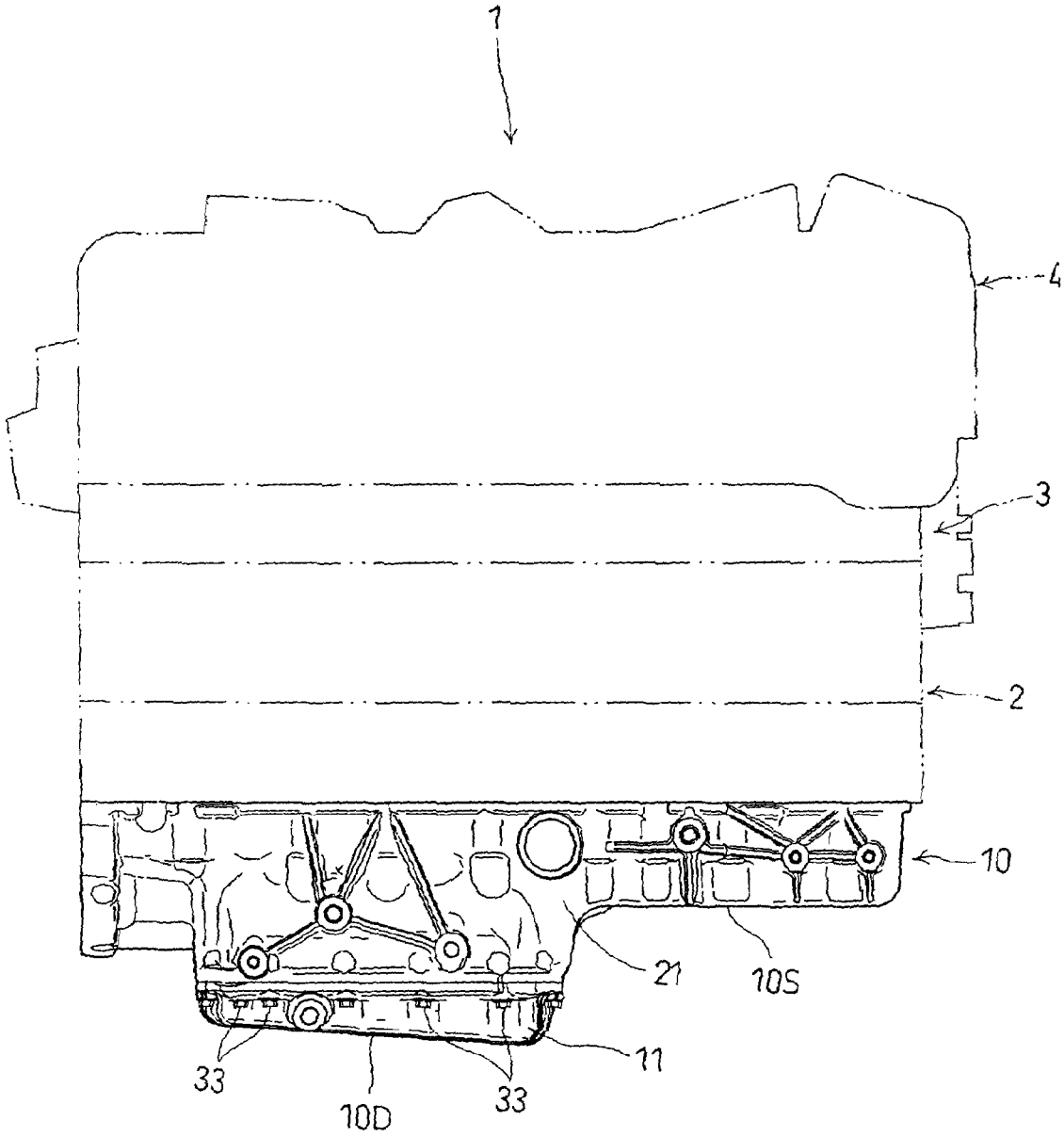
FIG. 1 is a side elevation of an oil pan in a preferred embodiment of the present invention, in which two-dot chain lines indicate an internal combustion engine.

The oil pan 10 is used in combination with an in-line five-cylinder four-cycle stroke internal combustion engine 1. The oil pan 10 forms a bottom part of the engine 1. FIG. 1 shows the oil pan 10 in a side elevation, in which the outline of the engine 1 is indicated by two-dot chain lines.

Hereinafter, terms, such as front, rear, right, left, longitudinal, lateral and such, are used to indicate positions, directions and such with respect to the direction of forward travel of the vehicle provided with the engine 1.

The engine 1 is a longitudinal engine mounted on the vehicle with its crankshaft longitudinally extended and the five cylinders arranged in a longitudinal straight row. FIG. 1 is a side elevation taken from the left side of the oil pan 10. In the engine 1, a cylinder head 3 is joined and fastened to the upper end of a cylinder block 2, the cylinder head 3 is covered with a cylinder head cover 4, and the oil pan 10 is joined to the lower end of the cylinder block 2.

The oil pan 10 is a longitudinally long, rectangular vessel. The oil pan 10 has a bottom wall having a front half part forming a shallow-bottom section 10S, and a part of a rear half part, excluding a rear end part, forming a deep-bottom section 10D deeper than the shallow-bottom section 10S.

Figure 7:
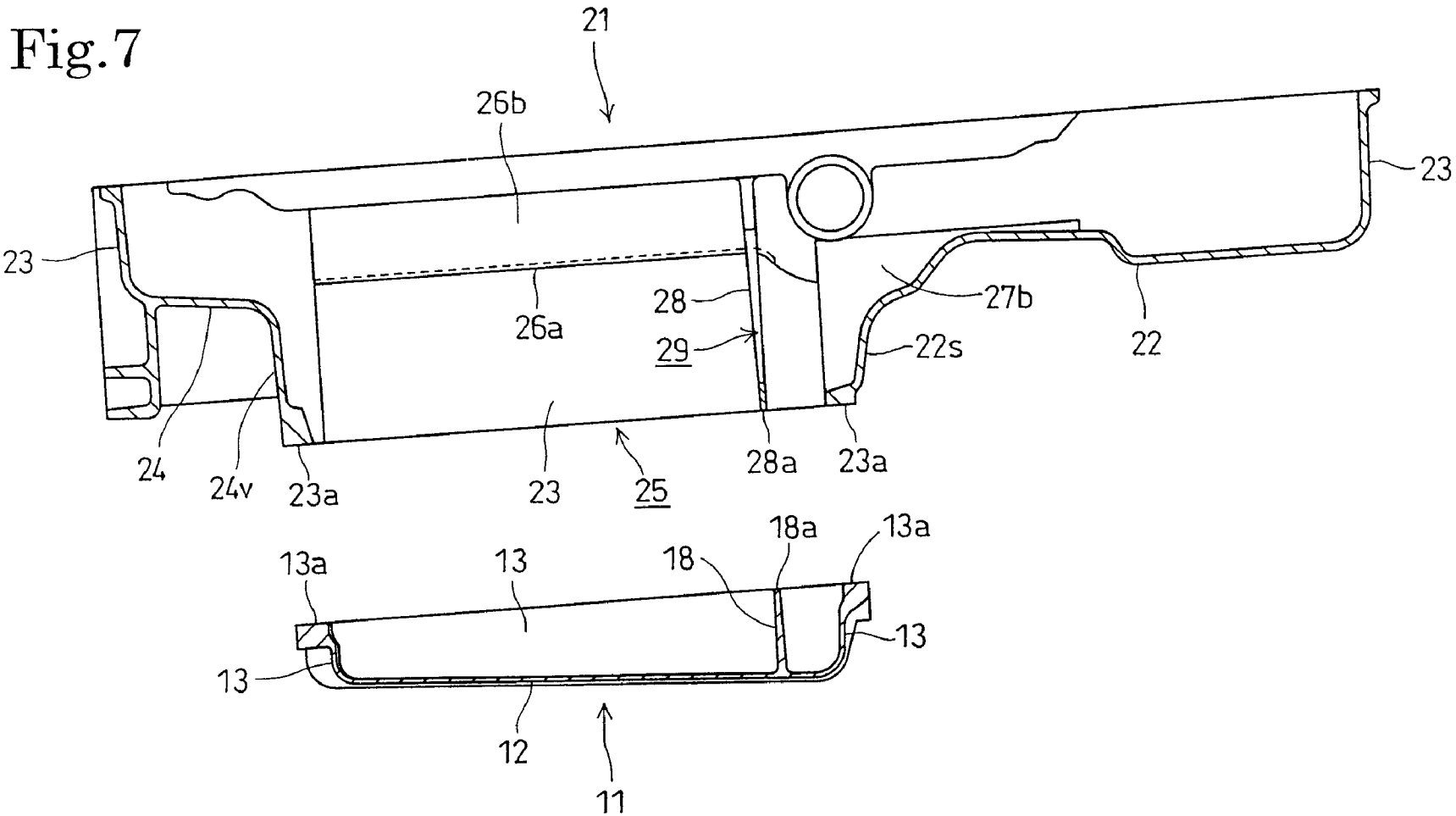
FIG. 7 is a sectional view of the upper and the lower oil pan element taken on the line VII-VII in FIGS. 5 and 6.
Figure 8:
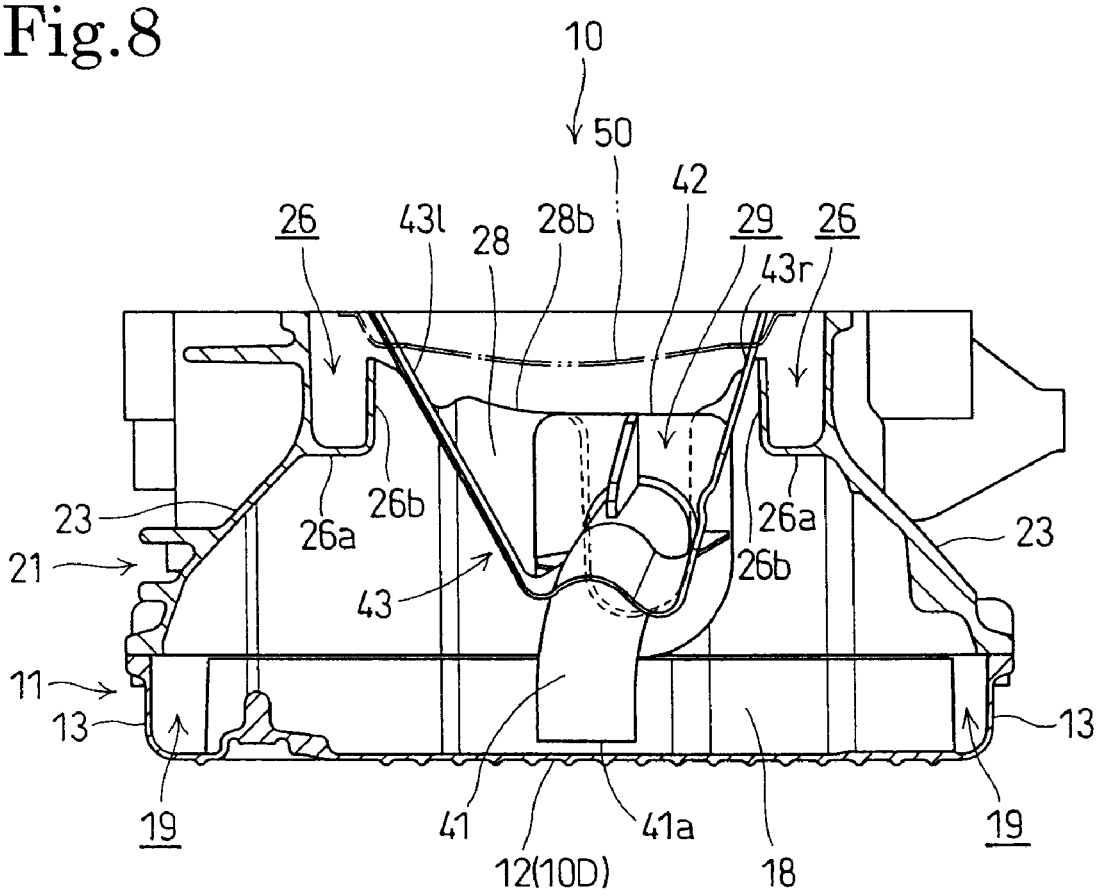
FIG. 8 is a sectional view of the upper and the lower half oil pan element taken on the line VIII-VIII in FIGS. 5 and 6.

When the vehicle is in a horizontal position and not tilted in any directions, the bottom wall of the shallow-bottom section 10S of the oil pan 10 slightly slopes down toward the rear. As shown in FIGS. 7 and 8, the oil pan 10 is divided into an upper half oil pan element 21 having the shallow-bottom section 10S, and a lower half oil pan element 11 having the deep-bottom section 10D.

Figure 6:
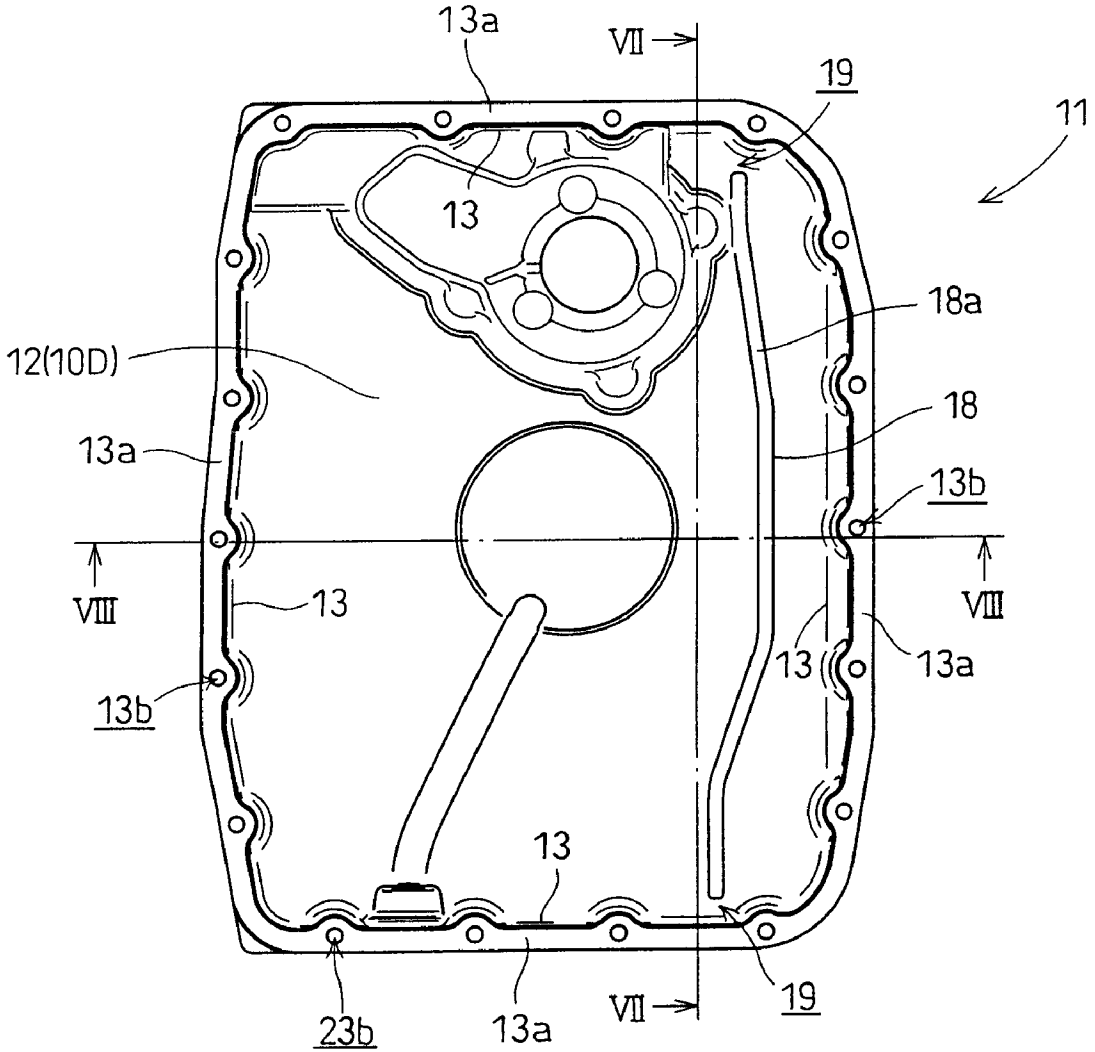
FIG. 6 is a top view of the lower half oil pan element.

Referring to FIGS. 6 to 8, the lower half oil pan element 11 is a somewhat laterally long, rectangular vessel having a rectangular bottom wall 12, and front, rear, right and left side walls 13 respectively rising from the front, the rear, the right and the left side of the bottom wall 12. Upper edge parts of the side walls 13 are extended outward to form a flange having an upper joining surface 13*a* to be joined to the upper half oil pan element 21. As shown in FIG. 6, bolt holes 13*b* are formed in the flange having the upper joining surface 13*a*. The bottom wall 12 of the lower half oil pan element 11 forms the deep-bottom section 10D.

A lower half baffle plate 18 is formed integrally with the bottom wall 12 so as to rise from the bottom wall 12 parallel to the front side wall 13. The lower half baffle plate 18 is at a short distance rearward from the front side wall 13. The upper end surface 18*a* of the lower half baffle plate 18 is at a level slightly below the level of the joining surface 13*a* of the side wall 13.

The right and the left end of the lower half baffle plate 18 are spaced a short distance apart from the right and the left side wall 13 to form gaps 19 between the right end of the lower half baffle plate 18 and the right side wall 13 and between the left end of the lower half baffle plate 18 and the left side wall 13, respectively. A middle part, with respect to a lateral direction, of the lower half baffle plate 18 is slightly bulged forward as shown.

Figure 5:
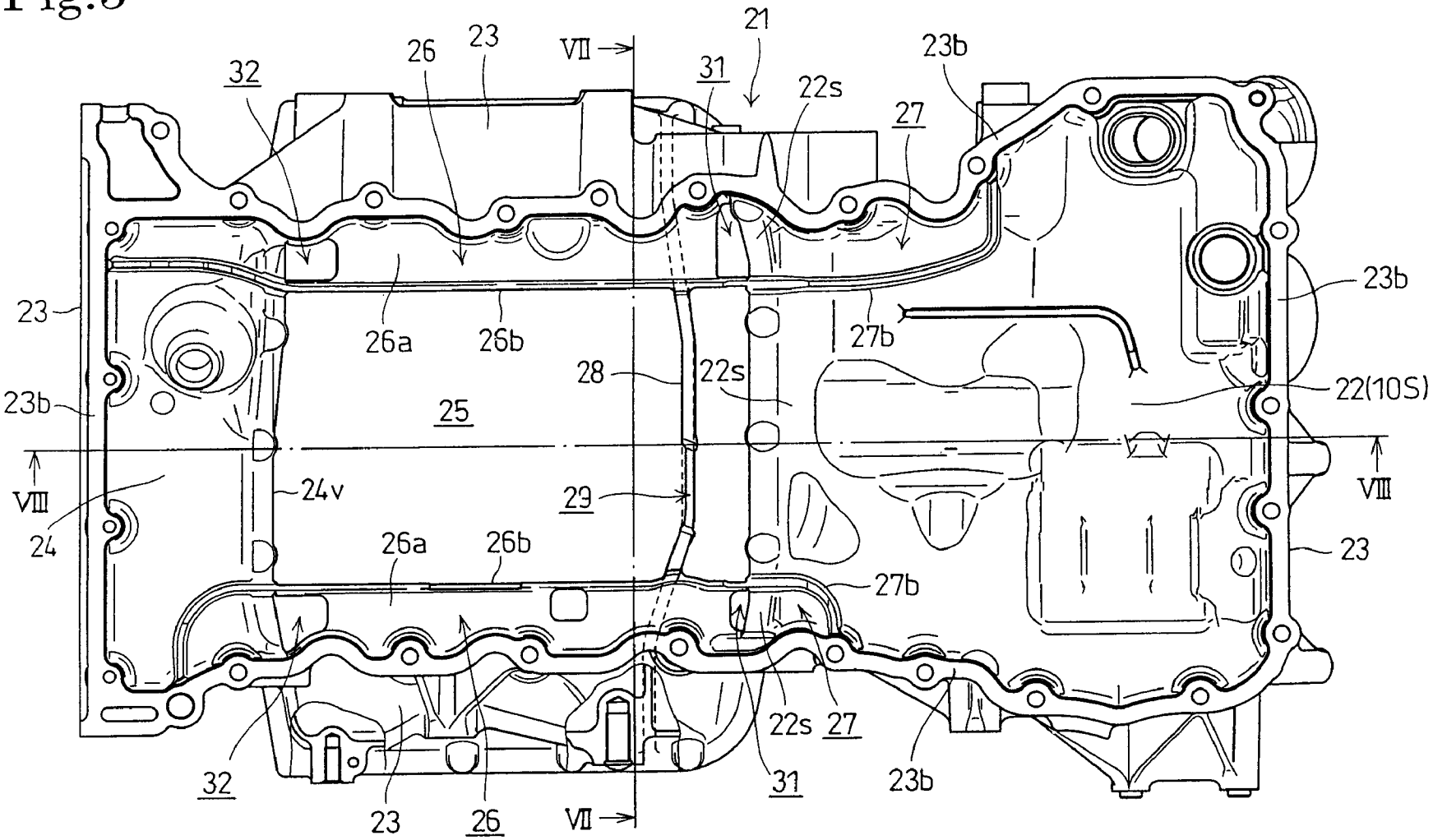
FIG. 5 is a top view of an upper half oil pan element.

Referring to FIGS. 5, 7 and 8, the upper half oil pan 21 is a longitudinally long rectangular frame having front, rear, right and left side walls 23, and a bottom wall 22 forming the shallow-bottom section 10S. The bottom wall 22 is in a front half part of the upper half oil pan element 21. A rectangular connecting opening 25 is formed in a rear part of the upper half oil pan element 21. The opening 25 opens into the lower half oil pan element 11. A shallow rear end bottom wall 24 having a relatively small longitudinal width is formed in a rear end part of the upper half oil pan element 21.

Lower portions of rear half parts of the right and the left side wall 23 are bulged laterally outward and extend downward to form right and left side walls defining the connecting opening 25. A rear part of the bottom wall 22 slopes down rearward gradually to form an inclined part 22*s* serving as a front end wall of the connecting opening 25. A front part of the rear end bottom wall 24 extends down forward to form a vertical wall 24*v*. The vertical wall 24*v* is the rear side wall of the connecting opening 25. The front, the rear, the right and the left side wall connect to the front, the rear, the right and the left side wall 13 of the lower half oil pan element 11, respectively.

Right and left trough-like, longitudinal oil passages 26 are formed along the right and the left side walls 23 of the rear half part of the upper half oil pan element 21. Each of the oil passages 26 is formed by longitudinally extending a bottom wall 26*a* and an inner side wall 26*b* along an upper inside surface of each of the right and the left side walls 23. The right and the left oil passages 26 are substantially symmetrical with respect to the longitudinal center axis of the upper half oil pan element 21.

Formed in a front half part of the upper half oil pan element 21 are trough-like oil passages 27 defined respectively between the right side wall 23 and a right inner wall 27*b* formed integrally with and rising from the bottom wall 22, and between the left side wall 23 and a left inner wall 27*b* formed integrally with and rising from the bottom wall 22. As shown in FIG. 7, the upper edges of the inner wall 27*b* forming the oil passages 27 are horizontal and substantially level with the bottom walls 26*a* of the oil passages 26. As shown in FIG. 5, front end parts of the inner walls 27*b* are bent outward and connected to the side walls 23 to close the front ends of the oil passages 27.

As mentioned above, the bottom wall 22 has the inclined part 22*s* sloping down rearward. The oil passages 27 are formed by using parts of the bottom wall 22. Therefore, the depth of the oil passages 27 increases from the closed front ends toward the connecting opening 25.

The bottom walls 26*a* of the oil passages 26 formed in the rear part of the upper half oil pan element 21 are substantially level with the upper edges of the inner walls 27*b* of the oil passages 27. Front end parts of the bottom walls 26*a* are bent slightly so as to slope downward and have cutouts, respectively. As shown in FIG. 5, a vertically elongated oil return port 31 is formed between the front end edge, at a high level, of each of the bottom walls 26*a* of the oil passages 26, and the rear end edge, at a low level, of each of the bottom walls 22 of the oil passages 27. Other oil return ports 32 are formed in rear end parts of the bottom walls 26*a* of the oil passages 26, respectively.

An upper half baffle plate 28 is formed integrally with the upper half oil pan element 21 at a position above the front part of the connecting opening 25 and in a rear part of the upper half oil pan element 21 so as to extend vertically between the right and the left side wall 23.

The upper half baffle plate 28 has an upper part extended between the right and the left inner wall 26*b* of the right and the left oil passage 26, and a lower part extending to the joining surface 23*a* joined to the lower half oil pan element 11. The lower end edge of the lower part of the upper half baffle plate 28 is flush with the joining surface 28*a*.

As shown in FIG. 8, the lateral width of the upper part of the upper half baffle plate 28 extending between the inner walls 27*b* is narrow, and the lateral width of the lower part of the upper half baffle plate 28 extending between the laterally bulged right and the left side wall 23 widens toward the lower end of the upper half baffle plate 28. A middle part of the upper half baffle plate 28, similarly to the middle part of the lower half baffle plate 18, is bulged forward slightly.

Figure 4:
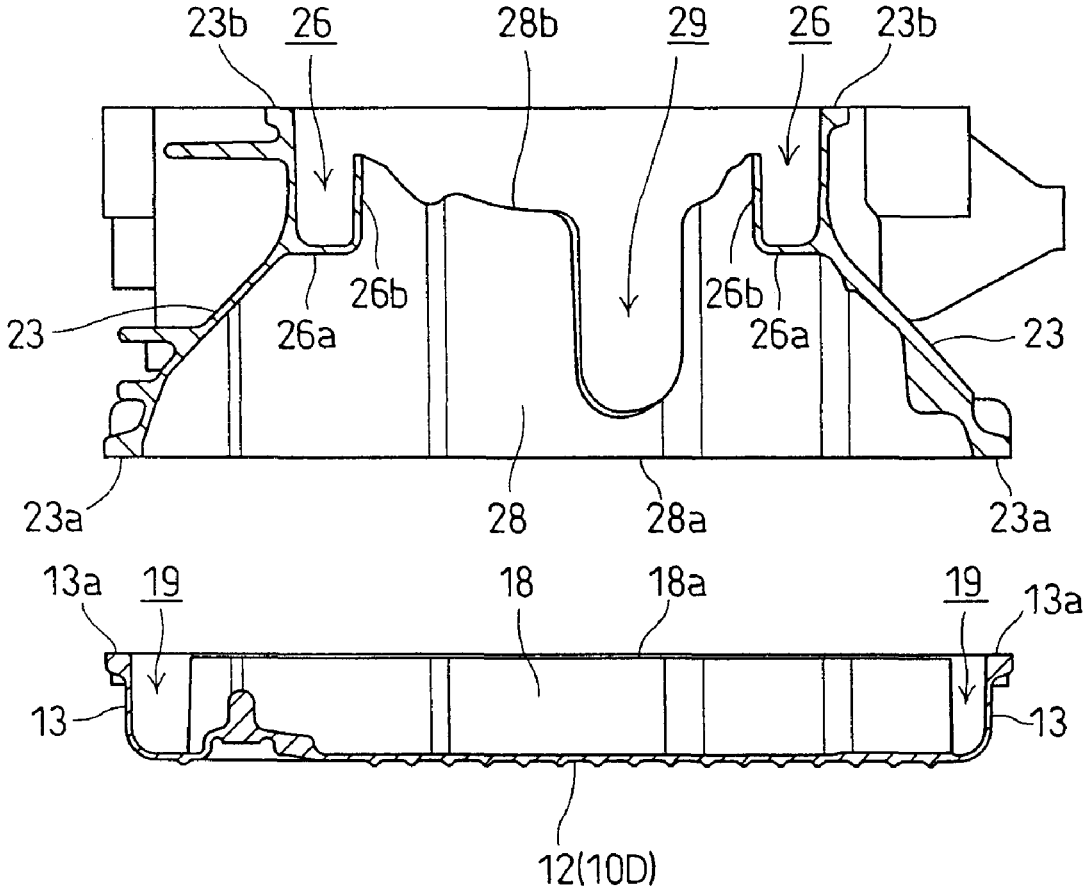
FIG. 4 is a sectional view taken on the line IV-IV in FIG. 3.

When the upper half oil pan element 21 and the lower half oil pan element 11 are joined together with the upper opening of the lower half oil pan element 11 aligned with the connecting opening 25 of the upper half oil pan element 21, the upper half baffle plate 28 and the lower half baffle plate 18 form a single vertical wall. A gap on the order of 0.5 mm is formed between the lower end surface 28*a* of the upper half baffle plate 28 and the upper end surface 18*a* of the lower half baffle plate 18 because the upper end surface 18*a* of the lower half baffle plate 18 is recessed below the joining surface 23*b* of the joining surfaces 13*a* of the side walls 13 as shown in FIG. 4.

The upper ends of the opposite inner side walls 26*b* forming the oil passages 26 are at a level below the joining surface 23*b* to be joined to the cylinder bock 2. Opposite side parts of the upper end surface 28*b* of the upper half baffle plate 28 decline gradually toward the middle of the upper half baffle plate 28. Parts of each of the opposite side parts of the upper end surface 28*b* are inclined at different inclinations. A deep concavity 29 for receiving the oil strainer is formed in a part of the upper half baffle plate 28 at a short distance to the right from the middle of the upper half baffle plate 28.

When the upper half oil pan element 21 and the lower half oil pan element 11 are joined together with the upper opening of the lower half oil pan element 11 aligned with the connecting opening 25 of the upper half oil pan element 21 by bringing the joining surfaces 23*a* and 13*a* together and fastening the upper half oil pan element 21 and the lower half oil pan element 11 together with bolts 33, the upper half baffle plate 28 and the lower half baffle plate 18 are aligned to form a substantially single vertical wall. A small gap is formed between the lower end surface 28*a* of the upper half baffle plate 28 and the upper end surface 18*a* of the lower half baffle plate 18.

Figure 3:
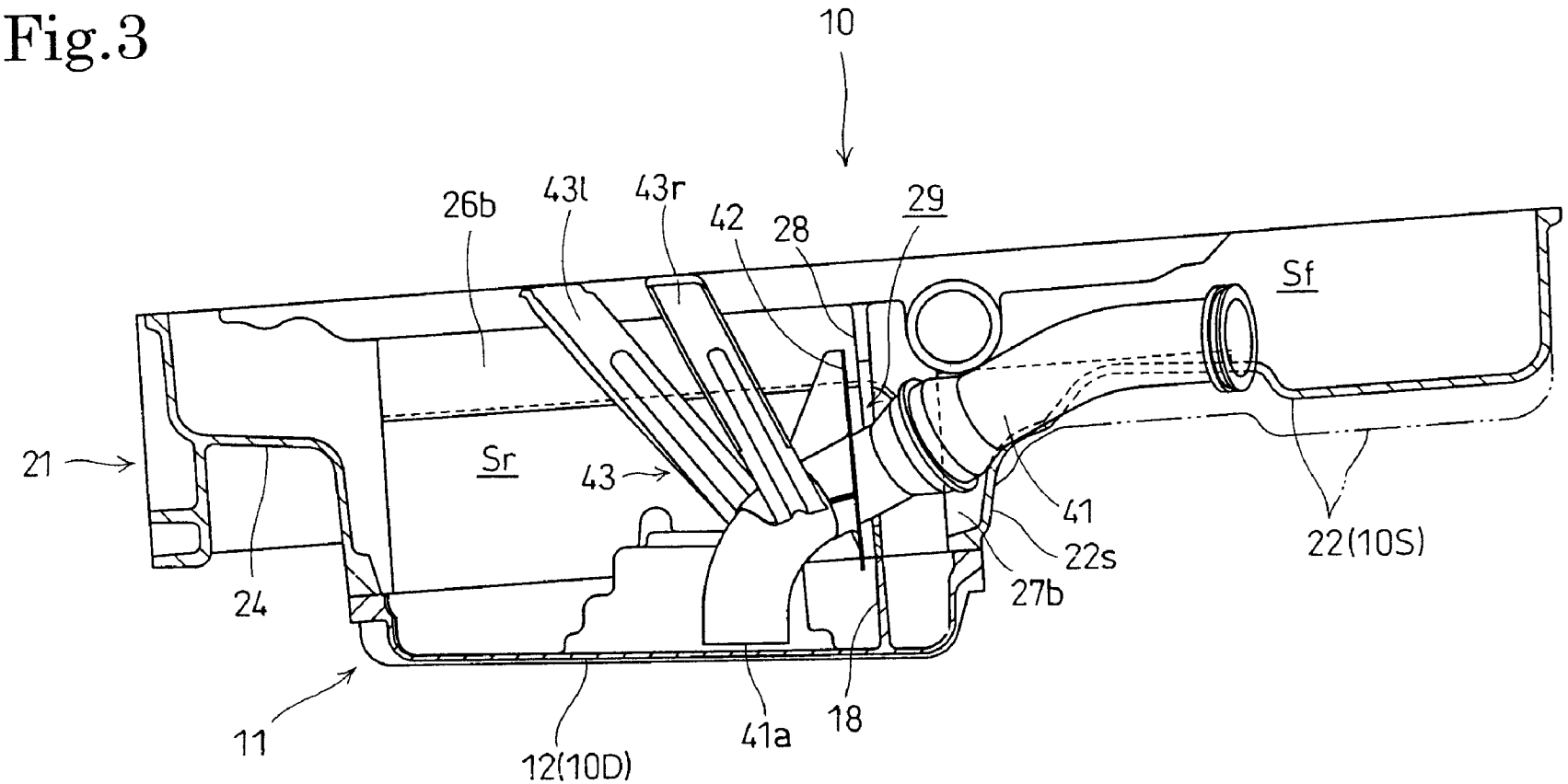
FIG. 3 is a sectional view taken on the line III-III in FIG. 2.

Referring to FIG. 3, the internal space of the oil pan 10 is divided by the upper half baffle plate 28 and the lower half baffle plate 18 into a shallow space Sf in the front shallow-bottom section 10S, and a deep space Sr occupying most part of the rear deep-bottom section 10D. A front deep part, on the front side of the lower half baffle plate 18, in the deep-bottom section 10D formed by the bottom wall 12 of the lower half oil pan element 11 is separated from the rear deep space Sr by the lower half baffle plate 18 and is continuous with the shallow space Sf.

The oil return ports 31 formed on the front side of the front ends of the bottom walls 26*a* of the right and the left oil passages 26 open into the shallow space Sf on the front side of the upper half baffle plate 28 and the lower half baffle plate 18.

An oil pump is disposed at a position slightly to the right on the bottom wall 22 of the shallow space Sf of the oil pan 10. A front end of a tubular oil strainer 41 is connected to the oil pump. The oil strainer 41 is extended obliquely rearward along the bottom surface of the shallow-bottom section 10S, is extended through the concavity 29 formed in the upper half baffle plate 28 into the deep space Sr. The oil strainer 41 is bent downward in the deep space SR such that a suction opening 41*a* formed at the rear end thereof is located adjacent to a central part of the bottom surface of the deep space SR.

Figure 2:
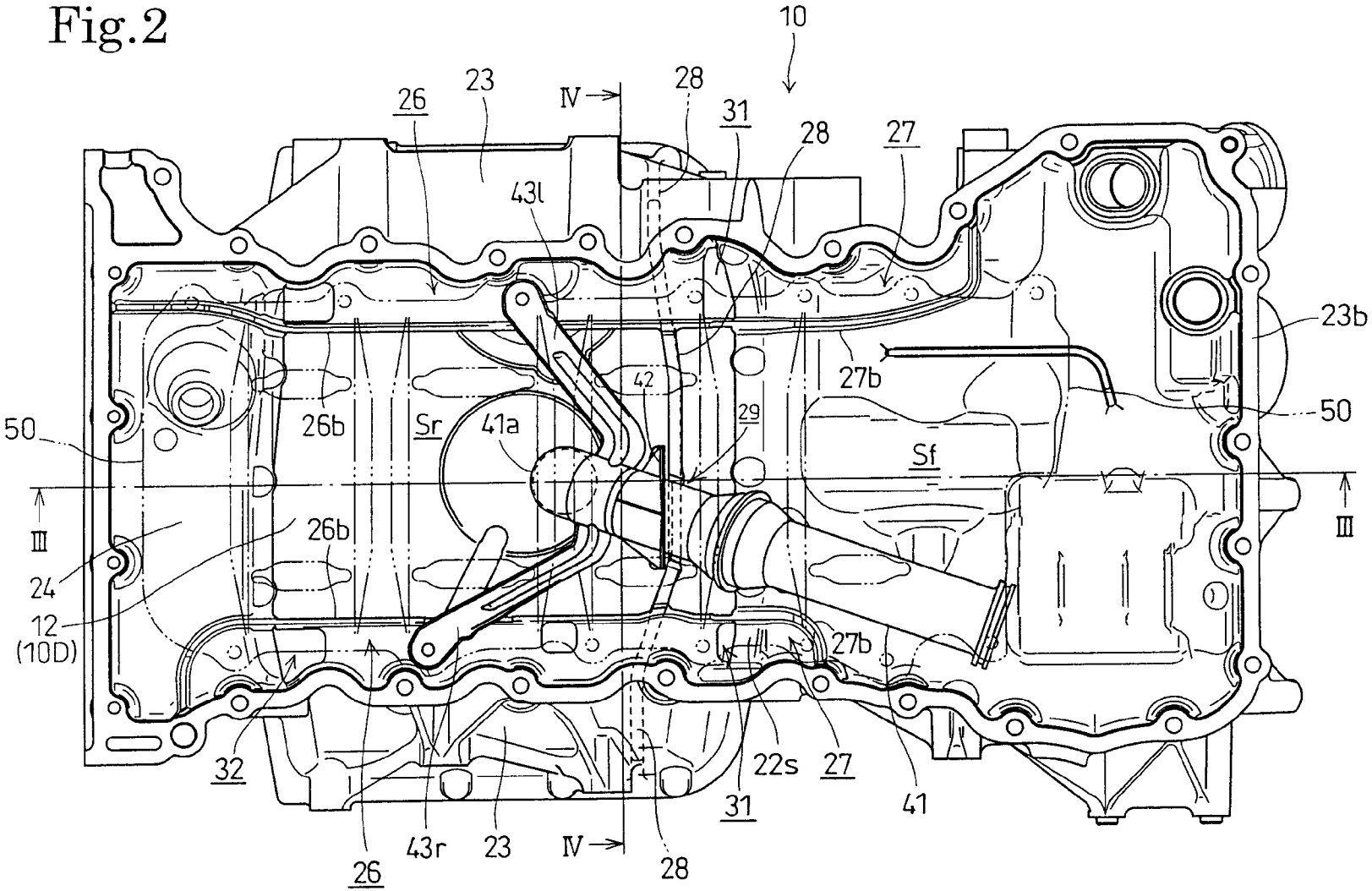
FIG. 2 is a top view of the oil pan shown in FIG. 1, combined with an oil strainer.

As shown in FIGS. 2, 3 and 4, a flange-like member 42 provided with a cylindrical central boss is put on the strainer 41. The flange-like member 42 is disposed close to the rear surface of the upper half baffle plate 28 parallel to the same 28. The central cylindrical boss of the flange-like member 42 is put on the strainer 41. The flange-like member 42 has rectangular right and left parts greater in area than the concavity 29 of the upper half baffle plate 28. The flange-like member 42 covers the concavity 29 in the deep place Sr.

A middle part of a support member 43 is attached to a part of the oil strainer 41 on the rear side of the flange-like member 42. The support member 43 has support arms 43*r* and 43*l* extending obliquely rightward and obliquely leftward, respectively. The upper ends of the support arms 43*r* and 43*l* are fastened with bolts to bosses protruding into the oil passages 26. Thus the rear part of the oil strainer 41 is supported by the support member 43 and the front end of the oil strainer 41 is connected to the oil pump to suspend the oil strainer 41.

The oil strainer 41 is completely sunk in the concavity 29 formed in the upper end surface 28*a* of the upper half baffle plate 28 and any part of the oil strainer 41 does not protrude from the upper end of the concavity 29. Therefore, the cylinder block 2 does not need to provide any space for the oil strainer 41 and the internal combustion engine can be built in a low height.

The open upper end of the oil pan 10 is covered with a horizontal baffle plate 50 to separate the interior of the oil pan 10 from a space in which the crankshaft is extended. As indicated by two-dot chain lines in FIGS. 2 and 4, the horizontal baffle plate 50 is a longitudinally elongated, rectangular plate extending horizontally between the right and the left oil passages 26 and 27. The horizontal baffle plate 50 is curved in a downward convex shape to prevent interference between the horizontal baffle plate 50, and the webs of the rotating crankshaft disposed above the horizontal baffle plate 50. The horizontal baffle plate 50 is provided with openings arranged in right and left longitudinal rows.

The upper end surface 28*a* of the upper half baffle plate 28 is adjacent to the horizontal baffle plate 50. The horizontal baffle plate 50 suppresses the waving of the oil contained in the oil pan 10 caused by the jolting of the vehicle to reduce the absorption of air by the oil to the least possible extent.

In the oil pan thus constructed, the oil collected on the bottom wall 22 in the shallow-bottom section 10S flows rearward along the bottom surface sloping down toward the rear and the inclined part 22*s* into the deep-bottom section 10D. The oil is reserved mainly in the deep-bottom section 10D (bottom wall 12).

The interior of the deep-bottom section 10D is divided into a front space and a rear space by the upper half baffle plate 18 and the lower half baffle plate 18. The front and the rear space respectively on the front and the rear side of the lower half baffle plate 18 communicate with each other by way of the gaps 19 at the right and the left end of the lower half baffle plate 18. The oil flows through the gaps 19 from the front space into the rear space in the deep space Sr. An amount of the oil not smaller than a predetermined amount is reserved always in the deep space Sr so that the suction opening 41*a* of the oil strainer 41 disposed in the deep space Sr may be always sunk in the oil reserved in the deep space Sr to avoid sucking air into the oil strainer 41.

The oil flows into the deep space Sr through the right and the left gap 19 at the right and the left end of the lower half baffle plate 18 apart from the suction opening 41*a* of the oil strainer 41 disposed in the central part of the deep space Sr. Therefore, suction of the oil containing air absorbed while the oil flows through the gaps 19 can be prevented in an utmost possible degree.

The forward flow of the oil from the deep space Sr into the shallow space Sf when the traveling vehicle decelerates is dammed back by the upper half baffle plate 28 and the lower half baffle plate 18 so that the suction opening 41*a* of the oil strainer 41 may not appear outside the oil reserved in the deep space Sr due to the reduction of the amount of the oil contained in the deep space Sr. Thus suction of air by the oil strainer 41 is prevented.

The respective middle parts of the upper half baffle plate 28 and the lower half baffle plate 18 are bulged forward to form the deep space Sr in the largest possible volume and to hold the oil caused to move forward by the deceleration of the vehicle by the bulged middle parts to suppress the amount of the oil that flows through the gaps 19 into the shallow space Sf.

The concavity 29 through which the strainer 41 is extended is formed in the upper half baffle plate 28. The flange-like member 42 has rectangular right and left flange parts greater than the concavity 29 of the upper half baffle plate 28. Since the concavity 29 is covered with the flange-like member 42 put on the oil strainer 41 so as to be located close to the concavity 29 from the side of the deep space Sr, the oil tending to flow from the deep space Sr through the concavity 29 into the shallow space Sf is stopped by the flange-like member 42, so that the flow of the oil into the shallow space Sf can be suppressed.

The trough-shaped oil passages 26 and 27 are formed in the right and the left side part of the upper half oil pan 21. Drip of the oil from the oil passages 26 into the deep-bottom section 10D is regulated to suppress the suction of the oil containing absorbed air into the oil strainer 41.

The oil that has flowed into the oil passages 27 on the front side flows rearward along the inclined part 22*s* of the bottom wall 22 and drops through the oil return ports 31 into the deep-bottom section 10D. If the oil collected in the rear oil passages 26 flows forward, the oil drops through the oil return ports 31 into the deep-bottom section 10D.

The oil return ports 31 are located in the part of the deep-bottom section 10D but on the front side of the half baffle plates 18 and 28 connecting to the shallow space Sf. Further, the oil return ports 31 are separated by the half baffle plates 18 and 28 from the deep space Sr in which the suction opening 41*a* of the oil strainer 41 is located. Thus the half baffle plates 18 and 20 prevents disturbance of the oil reserved in the deep space Sr by the oil that flows and drops through the oil return ports 31. Consequently, the oil reserved in the deep space Sr is stabilized and suction of air into the oil strainer 41 can be prevented to an utmost possible degree.

The oil return ports 32 are formed in the rear end parts of the bottom walls 26*a* of the oil passages 26, respectively. The oil collected in the oil passages 26 is caused to flow rearward and drops through the oil return ports 32 into the deep-bottom section 10D. The oil return ports 32 are disposed in the right and the left side parts of the rear part of the deep space Sr and are spaced a long distance apart from the suction opening 41 of the oil strainer 41 disposed in the central region of the deep space Sr. Therefore, the oil that has dropped through the oil return ports 32 will not disturb the suction of the oil by the oil strainer 41. The distance between the suction opening 41*a* of the oil strainer 41 and each of the rear oil return ports 32 is longer than that between the suction opening 41*a* of the oil strainer 41 and each of the front oil return ports 31.

The oil pan 10 is divided into the upper half oil pan element 21 having the shallow-bottom section 10S, and the lower half oil pan element 11 having the deep-bottom section 10D. The substantially vertical upper half baffle plate 28 is formed integrally with the upper half oil pan element 21, and the substantially vertical lower half baffle plate 18 is formed integrally with the lower half oil pan element 11. Therefore, the upper half oil pan element 21 integrally provided with the upper half baffle plate 28, and the lower half oil pan element 11 integrally provided with the lower half baffle plate 18 can be formed by casting. The oil pan 10 provided with the baffle plate can be built simply by joining together the upper half oil pan element 21 and the lower half oil pan element 11. Thus the oil pan 10 has a small number of component parts, can be made by small man-hours, and can be manufactured by reduced time and labor.

The respective half baffle plates 18 and 28 of the lower half oil pan element 11 and the upper half oil pan element 21 serve as ribs to enhance the rigidity of the lower and upper half oil pan elements 11 and 21.

Since the half oil pan elements individually provided with the half baffle plates have increased rigidity, the half oil pan elements can be securely joined together.

Since the half baffle plates are formed integrally with the half oil pan elements, gaps are hardly formed between the half oil pan elements and the corresponding half baffle plates.

The connecting openings formed in the right and the left end part of the lower half baffle plate 18 are the gaps 19 extending downward from the upper end surface 18*a* of the lower half baffle plate 18. Therefore, the lower half baffle plate 18 can be easily formed integrally with the lower half oil pan element 11 by casting without requiring machining work.

Since the gaps 19 and the concavity 29 for the strainer 41 are formed in the lower half baffle plate 18 and the upper half baffle plate 28, respectively, reduction of the rigidity of the lower half baffle plate 18 and that of the upper half baffle plate 28 can be limited to a minimum.

Ribs or protrusions may be formed on the surfaces of the lower half baffle plate 18 and the upper half baffle plate 18 to enhance the rigidity of the lower and upper half baffle plate 18 and 28. The waving of the oil can be suppressed by forming the ribs or protrusions in a shape effective in breaking waves, such as the shape of a grid.

Although the present invention has been described in terms of the oil pan 10 to be attached to the lower end of the cylinder block 2, the present invention is applicable to the lower block of an internal combustion engine using a bottom part thereof as an oil reservoir.

The oil pan 10 in this embodiment is divided into two parts, namely, the upper and the lower half oil pan elements, together with the baffle plate. The present invention is applicable to an oil pan divided into three or more parts with respect to a vertical direction.

In the oil pan 10 in this embodiment, the half baffle plates 18 and 28 divide the interior of the oil pan into the front and the rear section. The present invention is applicable to an oil pan having an interior space divided into right and left sections by a baffle plate.

Although the invention has been applied to the oil pan for the longitudinal internal combustion engine 1 mounted on the vehicle with its crankshaft extended longitudinally, the present invention is applicable also to an oil pan for a transverse internal combustion engine mounted on a vehicle with its crankshaft laterally extended.

What is claimed is:

1. An oil pan, for an internal combustion engine, disposed in a lower part of the internal combustion engine, said oil pan comprising:

an oil pan body having a shallow-bottom section with a smaller depth, and a deep-bottom section with a greater depth; and a baffle plate disposed between adjacent ones of the shallow-bottom section and the deep-bottom section to regulate flow of oil between adjacent ones of spaces defined by the shallow-bottom and deep-bottom sections, respectively, wherein:

the oil pan body is divided into upper and lower oil pan elements corresponding to the shallow-bottom and deep-bottom bottom sections, respectively, with respect to a vertical direction;

the baffle plate divides an interior space of the oil pan body into a deep space and a shallow space;

the baffle plate is divided into an upper half baffle plate and a lower half baffle plate respectively for the upper oil pan element and the lower oil pan element;

the upper half baffle plate is formed integrally with the upper oil pan element;

the lower half baffle plate is formed integrally with the lower oil pan element;

the baffle plate is provided with openings by way of which the deep space and the shallow space communicate with each other, said openings being formed in opposite side parts of the lower half baffle plate in the form of cutouts extending downward from an upper edge of the lower half baffle plate;

respective middle parts of the half baffle plates between the cutouts are bulged in a direction toward the shallow-bottom section; and, the deep-bottom section has a suction opening of an oil strainer for an oil pump in a central part of the deep-bottom section with respect to a direction along the baffle plate.

2. The oil pan for an internal combustion engine, according to claim 1, wherein a concavity is formed in the upper half baffle plate, and an oil strainer is extended through and held in the concavity from the shallow space into the deep space.

3. The oil pan for an internal combustion engine, according to claim 2, wherein the oil strainer suction opening is located adjacent to a substantially central part of the deep-bottom section in the deep space in the lower oil pan element:

trough-shaped oil passages are formed along inside surfaces of opposite side walls of the upper oil pan element adjacent to opposite side parts of the upper half baffle plate of the upper oil pan element; and return openings are formed in bottoms of the oil passages to cause oil to drop into the lower oil pan element.

4. The oil pan for an internal combustion engine, according to claim 3, wherein oil return openings are formed at least in the bottoms of the oil passages so as to open into the shallow space.

5. The oil pan for an internal combustion engine, according to claim 2, wherein the concavity through which the oil strainer is extended is formed in the upper baffle plate so as to open upward.

6. The oil pan for an internal combustion engine, according to claim 5, wherein the oil strainer is provided with a flange-like member greater in area than the concavity, and the flange-like member is disposed contiguously with the concavity.

7. The oil pan for an internal combustion engine, according to claim 1, wherein respective middle parts of the half baffle plates are bulged in a direction in which a vehicle on which the internal combustion engine is mounted runs for forward travel.

8. The oil pan for an internal combustion engine according to claim 1, wherein the lower oil pan element is separable from the upper oil pan element, and wherein the upper and lower oil pan elements are releasably affixed to one another.

* * * * *

UNITED STATES PATENT AND TRADEMARK OFFICE

CERTIFICATE OF CORRECTION

PATENT NO. : 7,748,500 B2
APPLICATION NO. : 12/108834
DATED : July 6, 2010
INVENTOR(S) : Nagano et al.

It is certified that error appears in the above-identified patent and that said Letters Patent is hereby corrected as shown below:

In Column 9, Line 40, in Claim 1, after "deep-bottom" delete "bottom".

In Column 10, Line 22, in Claim 3, delete "element:" and insert -- element; --

Signed and Sealed this

Twenty-third Day of November, 2010

David J. Kappos

David J. Kappos
*Director of the United States Patent and Trademark Office*